US010751793B2

(12) United States Patent
Bronfin et al.

(10) Patent No.: US 10,751,793 B2
(45) Date of Patent: Aug. 25, 2020

(54) CREEP RESISTANT, DUCTILE MAGNESIUM ALLOYS FOR DIE CASTING

(71) Applicant: DEAD SEA MAGNESIUM LTD., Beer Sheva (IL)

(72) Inventors: Boris Bronfin, Beer Sheva (IL); Nir Nagar, Beer Sheva (IL); Nir Moscovitch, Beer Sheva (IL); Meir Cohen, Meitar (IL)

(73) Assignee: DEAD SEA MAGNESIUM LTD., Beer Sheva (IL)

( * ) Notice: Subject to any disclaimer, the term of this patent is extended or adjusted under 35 U.S.C. 154(b) by 64 days.

(21) Appl. No.: 15/322,539

(22) PCT Filed: Jun. 24, 2015

(86) PCT No.: PCT/IL2015/050646
§ 371 (c)(1),
(2) Date: Dec. 28, 2016

(87) PCT Pub. No.: WO2016/178204
PCT Pub. Date: Nov. 10, 2016

(65) Prior Publication Data

US 2017/0129006 A1 May 11, 2017

(30) Foreign Application Priority Data

May 7, 2015 (IL) ..... 238698

(51) Int. Cl.
*B22D 21/00* (2006.01)
*C22C 23/02* (2006.01)
(Continued)

(52) U.S. Cl.
CPC ..... *B22D 21/007* (2013.01); *B22D 7/005* (2013.01); *B22D 17/00* (2013.01); *C22C 1/02* (2013.01); *C22C 23/02* (2013.01); *C22C 23/06* (2013.01)

(58) Field of Classification Search
CPC ..... C22C 23/02; C22C 23/06
See application file for complete search history.

(56) References Cited

U.S. PATENT DOCUMENTS 6,139,651 A * 10/2000 Bronfin ..... C22C 23/02 148/420
6,467,527 B1 10/2002 Kubota et al.
(Continued)

FOREIGN PATENT DOCUMENTS

CN 101440450 5/2009
CN 101191167 A 8/2010
(Continued)

OTHER PUBLICATIONS

Chao-Chi Jain, Chun-Hao Koo, Creep and Corrosion Properties of the Extruded Magnesium Alloy Containing Rare Earth, Materials Transactions, 2007, vol. 48, Issue 2, pp. 265-272. (Year: 2007).*
(Continued)

*Primary Examiner* — Alexandra M Moore
*Assistant Examiner* — Catherine P Smith
(74) *Attorney, Agent, or Firm* — Law Offices of Albert Wai-Kit Chan, PLLC

(57) ABSTRACT

The invention provides magnesium alloys for high temperature applications that combine excellent castability with superior corrosion resistance, and with good creep resistance, ductility, impact strength, and thermal conductivity. The alloys contain mainly Al, La, Ce, and Mn, and are particularly useful for high-pressure die casting process.

2 Claims, 7 Drawing Sheets

Table 6 The effect of aging at 150°C on the tensile properties

| Alloy | TYS [MPa] | | | UTS [MPa] | | | E [%] | | | Relative reduction in elongation ΔE/E [%] |
|---|---|---|---|---|---|---|---|---|---|---|
| | As cast | 1000h | 2000h | As cast | 1000h | 2000h | As cast | 1000h | 2000h | |
| Example 1 | 148 | 149 | 150 | 260 | 259 | 257 | 15 | 14 | 13 | 15 |
| Example 2 | 142 | 144 | 145 | 250 | 251 | 256 | 17 | 15 | 15 | 12 |
| Example 3 | 147 | 147 | 148 | 263 | 262 | 261 | 16 | 15 | 14 | 12 |
| Example 4 | 150 | 151 | 153 | 255 | 253 | 252 | 14 | 13 | 12 | 14 |
| Example 5 | 145 | 147 | 147 | 250 | 251 | 250 | 15 | 14 | 14 | 7 |
| Example 6 | 147 | 148 | 150 | 260 | 252 | 254 | 15 | 13 | 13 | 15 |
| Example 7 | 146 | 148 | 148 | 257 | 256 | 255 | 15 | 14 | 13 | 15 |
| Example 8 | 144 | 145 | 146 | 255 | 256 | 256 | 17 | 16 | 16 | 6 |
| Example 9 | 152 | 153 | 154 | 252 | 254 | 251 | 13 | 13 | 11 | 15 |
| Example 10 | 155 | 156 | 158 | 252 | 252 | 251 | 12 | 12 | 11 | 8 |
| Example 11 | 151 | 151 | 152 | 254 | 253 | 252 | 14 | 13 | 12 | 14 |
| Example 12 | 148 | 148 | 149 | 259 | 257 | 258 | 15 | 14 | 14 | 7 |
| Comparative example 1 | 140 | 143 | 145 | 241 | 240 | 239 | 11 | 9 | 7 | 36 |
| Comparative example 2 | 138 | 140 | 141 | 240 | 241 | 238 | 12 | 11 | 8 | 33 |
| Comparative example 3 | 147 | 148 | 150 | 242 | 240 | 240 | 9 | 7 | 5 | 44 |
| Comparative example 4 | 130 | 132 | 135 | 248 | 247 | 246 | 14 | 11 | 9 | 36 |
| Comparative example 5 | 142 | 142 | 147 | 243 | 240 | 241 | 10 | 8 | 7 | 33 |
| Comparative example 6 | 140 | 141 | 143 | 240 | 241 | 241 | 12 | 9 | 6 | 25 |
| Comparative example 7 | 140 | 142 | 146 | 240 | 239 | 236 | 11 | 9 | 7 | 36 |
| Comparative example 8 | 136 | 138 | 141 | 247 | 248 | 245 | 14 | 13 | 10 | 29 |

(51) Int. Cl.

| | |
|---|---|
| ***C22C 23/06*** | (2006.01) |
| ***B22D 7/00*** | (2006.01) |
| ***B22D 17/00*** | (2006.01) |
| ***C22C 1/02*** | (2006.01) |

(56) References Cited

U.S. PATENT DOCUMENTS

| | | | | |
|---|---|---|---|---|
| 2003/0086811 | A1* | 5/2003 | Bronfin | B22D 21/007 420/407 |
| 2004/0045639 | A1* | 3/2004 | Kikawa | C22C 23/00 148/420 |
| 2005/0238524 | A1* | 10/2005 | Barth | C22C 23/02 420/408 |
| 2009/0116993 | A1* | 5/2009 | Meng | C22C 23/02 420/405 |
| 2009/0133849 | A1 | 5/2009 | Bakke et al. | |
| 2010/0310409 | A1 | 12/2010 | Gibson et al. | |
| 2012/0070248 | A1* | 3/2012 | Kuwabara | C22C 23/02 411/378 |
| 2018/0016663 | A1* | 1/2018 | Iwamoto | B22D 21/04 |

FOREIGN PATENT DOCUMENTS

| | | | |
|---|---|---|---|
| CN | 102162053 | | 8/2011 |
| CN | 102776427 | | 11/2012 |
| CN | 102776427 | A * | 11/2012 |
| CN | 103451459 | A * | 12/2013 |
| CN | 103451459 | A | 12/2013 |
| CN | 104046871 | | 9/2014 |
| DE | 2122148 | | 12/1971 |
| EP | 1957221 | | 12/2011 |
| FR | 2090891 | | 1/1972 |
| JP | 2005187896 | A | 7/2005 |
| JP | 2005187895 | A | 1/2007 |
| WO | 2005/108634 | | 11/2005 |
| WO | 2017068332 | A1 | 4/2017 |

OTHER PUBLICATIONS

Jinghuai Zhang, Deping Zhang, Zheng Tian, Jun Wang, Ke Liu, Huayi Lu, Dingxiang Tang, Jian Meng, Microstructures, tensile properties and corrosion behavior of die-cast Mg—4Al-based alloys containing La and/or Ce, Materials Science and Engineering: A, vol. 489, Issues 1-2,2008, pp. 113-119. (Year: 2008).*

Rzychoń, Tomasz & Kielbus, Andrzej. (2006). Effect of rare earth elements on the microstructure of Mg—Al alloys. Journal of Achievements in Materials and Manufacturing Engineering. 17. (Year: 2006).*

Zhu, S., Easton, M.A., Abbott, T.B. et al. Metall and Mat Trans A (2015) 46: 3543. https://doi.org/10.1007/s11661-015-2946-9 (Year: 2015).*

Zhang J. et al., 2010, "Microstructures and mechanical properties of heat-resistent HPDC Mg-4 Al-based alloys containing cheap misch metal", Materials Science and Engineering A., 528:2670-77.

Zhang J. et al., 2008, "Effect of substituting cerium-rich mischmetal with lanthanum on microstructure and mechanical properties of die cast Mg—Al—Re alloys", Materials and Designs, 30:2372-2378.

PCT International Search Report, dated Sep. 20, 2015, for Dead Sea Magnesium Ltd., Int'l Application No. PCT/IL2015/050646, Filed Jun. 24, 2015.

PCT Written Opinion, dated Sep. 20, 2015, for Dead Sea Magnesium Ltd., Int'l Application No. PCT/IL2015/050646, Filed Jun. 24, 2015.

Supplementary European Search Report, dated Jan. 31, 2018, for Dead Sea Magnesium Ltd., European Application No. EP 15 89 1264.

Jain and Koo, Creep and Corrosion Properties of the Extruded Magnesium Alloy Containing Rare Earth, Materials Transactions, 2007, vol. 48(2), 265-272. [Exhibit 6].

Rzychon and Kielbus, Effect of rare earth elements on the microstructure of Mg—Al alloys, Journal of Achievements in Materials and Manufacturing Engineering, 2006, vol. 17(1-2), 149-152. [Exhibit 7].

Zhang et al., Microstructures, tensile properties and corrosion behavior of die-cast Mg—4Al-based alloys containing La and/or Ce, Materials Science and Engineering A, 2008, vol. 489, 113-119. [Exhibit 8].

* cited by examiner

Table 1 Chemical Compositions of Alloys [wt. %]

| Alloy | Al | Mn | Zn | La | Ce | Sn | Nd | Pr | Si | Fe | Ni | Cu | Be |
|---|---|---|---|---|---|---|---|---|---|---|---|---|---|
| Example 1 | 3.6 | 0.23 | - | 2.7 | 1.2 | - | - | - | 0.02 | 0.003 | 0.0007 | 0.0035 | 0.0003 |
| Example 2 | 2.6 | 0.32 | - | 2.9 | 0.4 | - | - | - | 0.01 | 0.003 | 0.0006 | 0.0014 | 0.0020 |
| Example 3 | 3.4 | 0.25 | - | 2.9 | 0.9 | - | - | - | 0.03 | 0.002 | 0.0008 | 0.0022 | 0.0007 |
| Example 4 | 3.7 | 0.21 | 0.03 | 3.1 | 0.8 | 0.10 | - | - | 0.02 | 0.002 | 0.0009 | 0.0011 | 0.0009 |
| Example 5 | 3.9 | 0.25 | 0.05 | 2.9 | 1.2 | 0.05 | 0.10 | 0.03 | 0.01 | 0.003 | 0.0008 | 0.0041 | 0.0009 |
| Example 6 | 4.0 | 0.27 | - | 3.0 | 1.3 | - | - | - | 0.02 | 0.002 | 0.0007 | 0.0033 | 0.0009 |
| Example 7 | 4.0 | 0.25 | 0.09 | 2.8 | 1.1 | 0.03 | - | - | 0.02 | 0.002 | 0.0008 | 0.0014 | 0.0016 |
| Example 8 | 3.3 | 0.29 | - | 3.5 | 0.1 | - | - | - | 0.01 | 0.003 | 0.0006 | 0.0009 | 0.0011 |
| Example 9 | 4.3 | 0.25 | - | 3.1 | 0.8 | 0.03 | - | - | 0.02 | 0.002 | 0.0008 | 0.0014 | 0.0006 |
| Example 10 | 5.5 | 0.23 | - | 2.9 | 1.4 | 0.16 | - | - | 0.03 | 0.003 | 0.0006 | 0.0012 | 0.0011 |
| Example 11 | 4.4 | 0.34 | - | 3.5 | 1.1 | 0.35 | - | - | 0.01 | 0.003 | 0.0007 | 0.0010 | 0.0009 |
| Example 12 | 4.1 | 0.22 | - | 2.8 | 1.5 | - | 0.15 | 0.04 | 0.01 | 0.003 | 0.0006 | 0.0017 | 0.0011 |
| Comparative Example 1 | 4.1 | 0.24 | - | 1.1 | 2.3 | - | 0.61 | 0.12 | 0.01 | 0.003 | 0.0008 | 0.0012 | 0.0002 |
| Comparative Example 2 | 3.9 | 0.28 | 0.35 | 1.4 | 2.6 | - | - | - | 0.02 | 0.003 | 0.0008 | 0.0034 | 0.0007 |
| Comparative Example 3 | 5.7 | 0.29 | 0.1 | 2.9 | 1.5 | 0.5 | - | - | 0.02 | 0.003 | 0.0008 | 0.0021 | 0.0008 |
| Comparative Example 4 | 2.6 | 0.35 | - | 0.9 | 3.2 | 0.05 | - | - | 0.01 | 0.002 | 0.0009 | 0.0012 | 0.0008 |
| Comparative Example 5 | 4.0 | 0.55 | - | 1.6 | 2.4 | - | - | - | 0.03 | 0.002 | 0.0006 | 0.0029 | 0.0006 |
| Comparative Example 6 | 3.0 | 0.24 | 0.51 | 1.65 | 2.7 | - | 0.89 | 0.19 | 0.04 | 0.003 | 0.0007 | 0.0046 | 0.0008 |
| Comparative Example 7 | 4.1 | 0.27 | - | 3.9 | - | - | - | - | 0.01 | 0.004 | 0.0006 | 0.0021 | 0.0009 |
| Comparative Example 8 | 4.5 | 0.27 | - | 1.7 | 0.9 | - | - | - | 0.03 | 0.003 | 0.0008 | 0.0032 | 0.0025 |

Fig. 1

The shot used for evaluation of susceptibility to hot cracking

Table 2 Die casting parameters used over hot cracking experiments

| PARAMETER | Value | | |
|---|---|---|---|
| Melt temperature [°C] | 675 | 705 | |
| Die temperature [°C] | 160 | 220 | |
| Intensification Pressure [MPa] | 16 | 30 | |
| Second phase piston velocity[m/s] | 2 | 4 | 6 |
| Totally 24 combinations of HPDC parameters | | | |

Fig. 3

Table.3 Percentage of crack free junctions depending on second phase piston velocity and intensification pressure for all die and melt temperatures

| Alloy | Second phase piston velocity [m/s] | | | | | |
|---|---|---|---|---|---|---|
| | 2.0 | | 4.0 | | 6.0 | |
| | P=16 MPa | P=30 MPa | P=16 MPa | P=30 MPa | P=16 MPa | P=30 MPa |
| Example 1 | 83 | 92 | 86 | 97 | 98 | 100 |
| Example 2 | 81 | 94 | 86 | 100 | 98 | 100 |
| Example 3 | 83 | 91 | 86 | 100 | 98 | 100 |
| Example 4 | 85 | 92 | 86 | 100 | 98 | 100 |
| Example 5 | 82 | 94 | 86 | 100 | 99 | 100 |
| Example 6 | 80 | 93 | 86 | 98 | 98 | 100 |
| Example 7 | 83 | 96 | 86 | 97 | 98 | 100 |
| Example 8 | 83 | 92 | 88 | 96 | 98 | 100 |
| Example 9 | 81 | 92 | 86 | 97 | 96 | 100 |
| Example 10 | 83 | 93 | 86 | 96 | 98 | 100 |
| Example 11 | 82 | 92 | 86 | 98 | 99 | 100 |
| Example 12 | 83 | 94 | 86 | 97 | 98 | 100 |
| Comparative Example 1 | 55 | 67 | 61 | 75 | 63 | 74 |
| Comparative Example 2 | 50 | 59 | 60 | 69 | 62 | 73 |
| Comparative Example 3 | 67 | 80 | 71 | 87 | 73 | 84 |
| Comparative Example 4 | 55 | 69 | 65 | 77 | 73 | 87 |
| Comparative Example 5 | 55 | 70 | 61 | 72 | 69 | 79 |
| Comparative Example 6 | 55 | 68 | 61 | 78 | 69 | 82 |
| Comparative Example 7 | 55 | 67 | 61 | 75 | 63 | 74 |
| Comparative Example 8 | 56 | 64 | 63 | 73 | 66 | 76 |

Fig. 4

Table 4. Mechanical properties

| Alloy | Bearing Yield Strength, BYS [MPa] | | Shear Strength [MPa] | | TYS [MPa] | | | UTS [MPa] | | | E [%] | Impact strength [ J ] |
|---|---|---|---|---|---|---|---|---|---|---|---|---|
| | 20°C | 150°C | 20°C | 150°C | 20°C | 150°C | 175°C | 20°C | 150°C | 175°C | 20°C | 20°C |
| Example 1 | 330 | 270 | 165 | 130 | 150 | 122 | 109 | 260 | 178 | 143 | 12 | 22 |
| Example 2 | 320 | 264 | 167 | 130 | 144 | 118 | 107 | 250 | 173 | 142 | 17 | 24 |
| Example 3 | 328 | 265 | 160 | 132 | 149 | 120 | 109 | 263 | 177 | 141 | 15 | 22 |
| Example 4 | 338 | 275 | 163 | 133 | 150 | 124 | 110 | 255 | 185 | 148 | 14 | 20 |
| Example 5 | 330 | 279 | 169 | 135 | 147 | 119 | 109 | 250 | 183 | 144 | 15 | 21 |
| Example 6 | 335 | 280 | 167 | 131 | 152 | 121 | 111 | 260 | 175 | 140 | 15 | 23 |
| Example 7 | 334 | 275 | 162 | 135 | 146 | 122 | 109 | 257 | 178 | 141 | 15 | 21 |
| Example 8 | 331 | 270 | 164 | 136 | 144 | 119 | 108 | 255 | 177 | 144 | 16 | 23 |
| Example 9 | 335 | 277 | 160 | 135 | 152 | 126 | 110 | 252 | 185 | 148 | 13 | 20 |
| Example 10 | 332 | 272 | 162 | 138 | 155 | 129 | 118 | 252 | 185 | 148 | 12 | 19 |
| Example 11 | 338 | 275 | 164 | 139 | 151 | 122 | 112 | 254 | 183 | 147 | 14 | 21 |
| Example 12 | 332 | 270 | 163 | 132 | 148 | 121 | 110 | 259 | 174 | 142 | 15 | 22 |
| Comparative example 1 | 286 | 227 | 155 | 110 | 140 | 117 | 99 | 241 | 157 | 132 | 11 | 17 |
| Comparative example 2 | 282 | 214 | 153 | 120 | 138 | 115 | 101 | 240 | 152 | 133 | 12 | 16 |
| Comparative example 3 | 303 | 230 | 158 | 130 | 147 | 113 | 99 | 242 | 160 | 129 | 9 | 14 |
| Comparative example 4 | 270 | 217 | 143 | 105 | 130 | 100 | 89 | 248 | 159 | 120 | 14 | 18 |
| Comparative example 5 | 285 | 226 | 145 | 107 | 142 | 115 | 99 | 243 | 155 | 131 | 10 | 17 |
| Comparative example 6 | 280 | 225 | 142 | 109 | 140 | 117 | 100 | 240 | 155 | 130 | 9 | 14 |
| Comparative example 7 | 305 | 230 | 158 | 130 | 140 | 118 | 98 | 240 | 155 | 130 | 11 | 15 |
| Comparative example 8 | 265 | 215 | 143 | 105 | 136 | 106 | 93 | 247 | 144 | 125 | 14 | 18 |

Fig. 5

Table 5 Thermal conductivity, creep, bolt load retention and corrosion properties

| Alloy | Thermal conductivity [W/K m] | Creep strength [MPa] to produce 0. 2% strain for 200 h | | Bolt Load Retention at initial stress of 80 MPa [%] | | CR [ mpy] |
|---|---|---|---|---|---|---|
| | 20°C | 150°C | 175°C | 150°C | 175°C | 20°C |
| Example 1 | 88 | 106 | 87 | 76 | 63 | 0.64 |
| Example 2 | 92 | 104 | 85 | 74 | 57 | 0.75 |
| Example 3 | 89 | 101 | 83 | 72 | 54 | 0.77 |
| Example 4 | 87 | 100 | 80 | 70 | 51 | 0.79 |
| Example 5 | 88 | 97 | 80 | 69 | 54 | 0.63 |
| Example 6 | 88 | 107 | 86 | 79 | 62 | 0.66 |
| Example 7 | 89 | 101 | 85 | 71 | 55 | 0.78 |
| Example 8 | 86 | 102 | 82 | 73 | 56 | 0.73 |
| Example 9 | 89 | 99 | 85 | 71 | 55 | 0.51 |
| Example 10 | 86 | 100 | 87 | 74 | 58 | 0.64 |
| Example 11 | 88 | 106 | 88 | 77 | 60 | 0.62 |
| Example 12 | 86 | 102 | 82 | 74 | 55 | 0.56 |
| Comparative Example 1 | 83 | 85 | 74 | 61 | 47 | 1.19 |
| Comparative Example 2 | 81 | 86 | 73 | 62 | 46 | 1.06 |
| Comparative Example 3 | 79 | 93 | 71 | 67 | 45 | 1.03 |
| Comparative Example 4 | 82 | 86 | 75 | 65 | 48 | 1.42 |
| Comparative Example 5 | 84 | 88 | 77 | 60 | 47 | 1.07 |
| Comparative Example 6 | 75 | 91 | 74 | 63 | 46 | 1.04 |
| Comparative Example 7 | 82 | 89 | 73 | 62 | 45 | 1.01 |
| Comparative Example 8 | 81 | 87 | 75 | 61 | 48 | 1.04 |

Fig. 6

Table 6 The effect of aging at 150°C on the tensile properties

| Alloy | TYS [MPa] | | | UTS [MPa] | | | E [%] | | | Relative reduction in elongation ΔE/E [%] |
|---|---|---|---|---|---|---|---|---|---|---|
| | As cast | 1000h | 2000h | As cast | 1000h | 2000h | As cast | 1000h | 2000h | |
| Example 1 | 148 | 149 | 150 | 260 | 259 | 257 | 15 | 14 | 13 | 15 |
| Example 2 | 142 | 144 | 145 | 250 | 251 | 256 | 17 | 15 | 15 | 12 |
| Example 3 | 147 | 147 | 148 | 263 | 262 | 261 | 16 | 15 | 14 | 12 |
| Example 4 | 150 | 151 | 153 | 255 | 253 | 252 | 14 | 13 | 12 | 14 |
| Example 5 | 145 | 147 | 147 | 250 | 251 | 250 | 15 | 14 | 14 | 7 |
| Example 6 | 147 | 148 | 150 | 260 | 252 | 254 | 15 | 13 | 13 | 15 |
| Example 7 | 146 | 148 | 148 | 257 | 256 | 255 | 15 | 14 | 13 | 15 |
| Example 8 | 144 | 145 | 146 | 255 | 256 | 256 | 17 | 16 | 16 | 6 |
| Example 9 | 152 | 153 | 154 | 252 | 254 | 251 | 13 | 13 | 11 | 15 |
| Example 10 | 155 | 156 | 158 | 252 | 252 | 251 | 12 | 12 | 11 | 8 |
| Example 11 | 151 | 151 | 152 | 254 | 253 | 252 | 14 | 13 | 12 | 14 |
| Example 12 | 148 | 148 | 149 | 259 | 257 | 258 | 15 | 14 | 14 | 7 |
| Comparative example 1 | 140 | 143 | 145 | 241 | 240 | 239 | 11 | 9 | 7 | 36 |
| Comparative example 2 | 138 | 140 | 141 | 240 | 241 | 238 | 12 | 11 | 8 | 33 |
| Comparative example 3 | 147 | 148 | 150 | 242 | 240 | 240 | 9 | 7 | 5 | 44 |
| Comparative example 4 | 130 | 132 | 135 | 248 | 247 | 246 | 14 | 11 | 9 | 36 |
| Comparative example 5 | 142 | 142 | 147 | 243 | 240 | 241 | 10 | 8 | 7 | 33 |
| Comparative example 6 | 140 | 141 | 143 | 240 | 241 | 241 | 12 | 9 | 6 | 25 |
| Comparative example 7 | 140 | 142 | 146 | 240 | 239 | 236 | 11 | 9 | 7 | 36 |
| Comparative example 8 | 136 | 138 | 141 | 247 | 248 | 245 | 14 | 13 | 10 | 29 |

Fig. 7

CREEP RESISTANT, DUCTILE MAGNESIUM ALLOYS FOR DIE CASTING

FIELD OF THE INVENTION

The present invention provides a family of magnesium based alloys for high temperature applications that combine excellent castability with good creep resistance, high ductility and impact strength, as well as with superior corrosion resistance. The alloys of the present invention are preferably dedicated for high-pressure die casting process. The invention provides a process for the preparation of the above alloys in ingot form by high pressure die casting.

BACKGROUND OF THE INVENTION

The use of magnesium alloys, aiming at reducing the weight of vehicles, is growing from year to year due to a number of their particularly advantageous properties, such as low density, high strength-to-weight ratio, good castability, easy machinability and good damping characteristics. Most of this growth has been associated with interior parts made of commercial magnesium alloys of AZ and AM families, that can operate only at temperatures up to 100° C. and therefore cannot be used for powertrain components that should serve at temperatures up to 150-175° C. The main problems in expanding the use of Mg alloys in the transportation industry are associated with their creep behavior, castability, corrosion behavior, and the costs.

Commercial die casting magnesium alloys of Mg—Al—Zn system, such as AZ91D, and of Mg—Al—Mn system, such as AM50A and AM60B exhibit good castability, improved corrosion resistance, and attractive mechanical properties at ambient temperature. However, the above alloys exhibit insufficient elevated temperature strength, poor creep resistance, and poor bolt load retention properties. Therefore these alloys can serve only at temperatures lower than 110° C. Recently several creep resistant magnesium alloy have been developed based on Mg—Al—Ca, Mg—Al—Sr, Mg—Al—Ca—Sr, Mg—Al—Sr—RE, and Mg—Al—Ca—Re alloying systems. It should be noted that the use of alkaline earth elements like Ca and Sr requires the Al content not less than 6% in order to avoid sticking to die and increased susceptibility to hot cracking. However, increased Al content results in the deterioration of creep resistance and thermal conductivity—two very important properties for the implementation of Mg alloys as housings for LED lighting devices, the application that has been penetrating the automotive industry at unprecedented rate for the last five years. For such applications, creep resistant magnesium alloys based on Mg—Al—RE alloying system can be considered as promising candidates. Several creep-resistant die casting Mg—Al—RE alloys have been developed and described. FR 2090881 and DE 2122148 relate to a magnesium alloy comprising 0.9-6.5 wt. % Al, 0.24-10 wt. % RE, 0-1.5 wt. % Mn, and common impurities wherein RE elements are employed as Ce-based mischmetal containing 50-60% Ce, 15-30% La, and the rest Didymium, which is usually a 3 to 1 mixture of Nd and Pr. U.S. Pat. No. 6,467,527 relates to a die casting process for a magnesium alloy comprising 1-10 wt. % Al, 0-1.5 wt. % Mn, and at least one alloying element selected from 0.2-5.0 wt. % RE metal, 0.02-5.0 wt. % Ca, and 0.2-10.0 wt. % Si. WO2005/108634 describes magnesium alloy comprising 1-10 wt. % Al, 1-8 wt. % RE elements wherein 40% or more of RE elements is Ce, 0-0.5 wt. % Mn, 0.0-1.0 wt. % Zn, 0-3.0 wt % Ca, and 0.0-3.0 wt. % Sr. EP 1957221 discloses die casting process of a magnesium alloy comprising 2.0-6.0 wt. % Al, 3.0-8.0 wt. % RE elements wherein 40% or more of RE elements is Ce, 0.0-0.5 wt. % Mn, 0.0-1.0 wt. % Zn, less than 0.01 wt. % Ca, less than 0.01 wt. % Sr, and the balance are unavoidable impurities. U.S. 2009/0116993 describes magnesium alloy containing 3.0-5.0 wt. % Al, 0.4-2.6 wt. % Ce, 0.4-2.6 wt. % La, 0.2-0.6 wt. % Mn, wherein the total amount of Fe, Cu and Ni impurities is less than 0.03 wt. %. CN 102162053 discloses the preparation of magnesium alloy comprising 3.0-5.0 wt. % Al, 3.5-4.5 wt. % of Ce based mischmetal, and 0.08-0.15 wt. % Ca. CN 102776427 relates to a magnesium alloy containing 3.5-4.4 wt. % Al, 0.17-0.25 wt. % Mn, and 5.5-6.4 wt. % RE elements wherein Ce, La and Nd account for 35-40 wt. %, 60-55 wt. %, and 5 wt. %, respectively. Furthermore, CN 101440450 describes a magnesium alloy comprising 3.5-4.5 wt. % Al, 1.0-6.0 wt. % La, 0.2-0.6 wt. % Mn, wherein the total amount of Fe, Cu and Ni impurities is less than 0.03 wt. %. CN 104046871 discloses a magnesium alloy comprising 3.5-4.5 wt. % Al, 2.5-3.5 wt. % La, 1.5-3.0 wt. Sm, 0.2-0.4 wt. % Mn, wherein the total amount of Fe, Cu and Ni impurities is less than 0.03 wt. %; it should be noted that the presence of the expensive element Sm makes the above invention unpractical and unsuitable for the industrial production.

It is an object of this invention to provide creep resistant magnesium-based alloys being suitable for elevated temperature applications, and showing superior energy absorption properties and good performance in the corrosive environment.

It is another object of the present invention to provide a process for preparing ingots of the above alloys.

It is a further object of the present invention to provide alloys that are especially well suitable for high-pressure die casting process, and which enable high casting rate.

It is a still further object of this invention to provide alloys which have low susceptibility to hot cracking and sticking to die.

It is also an object of this invention to provide alloys which have enhanced thermal conductivity.

It is also another object of this invention to provide alloys with improved bearing and shear properties at ambient and elevated temperatures.

It is further an object of this invention to provide alloys which demonstrate the aforesaid behavior and properties at an affordable cost.

Other objects and advantages of present invention will appear as description proceeds.

SUMMARY OF THE INVENTION

The invention provides a magnesium alloy comprising 2.6 to 5.5 wt. % Aluminum (Al), 2.7 to 3.5 wt. % Lanthanum (La); 0.1 to 1.6 wt. % Cerium (Ce); 0.14 to 0.50 wt. % Manganese (Mn); 0.0003 to 0.0020 wt. % Beryllium (Be), and optionally 0.00 to 0.35 wt. % Zinc (Zn), 0.00 to 0.40 wt. % Tin (Sn), 0.00 to 0.20 wt. % Neodymium (Nd), 0.00 to 0.10 wt. % Praseodymium (Pr), and the balance being magnesium and unavoidable impurities. In some embodiments of the invention, Zn may be in the range of 0.02 to 0.33 wt. %, Sn in the range of 0.02 to 0.38 wt. %, Nd in the range of 0.02 to 0.18 wt. %, and Pr in the range of 0.01 to 0.09 wt. %.

In a preferred embodiment of the invention, the alloy comprises 2.6 to 3.7 wt. % Al, 2.8 to 3.3 wt. % La, 0.3 to 1.6 wt. % Ce, 0.15 to 0.40 wt. % Mn, and 0.0006 to 0.0020 wt. % Be. In other preferred embodiment of the invention, the alloy comprises 3.0 to 4.5 wt. % Al, 2.7 to 3.2 wt. % La, 0.8 to 1.6 wt. % Ce, 0.05 to 0.25 wt. % Sn, 0.15 to 0.40 wt. % Mn, and 0.0004 to 0.0012 wt. % Be. In a still other preferred embodiment of the invention, the alloy comprises 2.9 to 4.3 wt. % Al, 2.7-to 3.4 wt. % La, 0.4 to 1.6 wt. % Ce, 0.05 to 0.15 wt/% Nd, 0.01 to 0.08 wt. % Pr, 0.15 to 0.35 wt. % Mn, 0.03 to 0.09 wt. % Zn, 0.03 to 0.15 wt. % Sn and 0.0006 to 0.0010 wt. % Be.

The invention is directed to a process for manufacturing a magnesium alloy combining good castability, creep resistance, and corrosion performance with high ductility, impact strength, and thermal conductivity, comprising alloying 2.6 to 5.5 wt. % Al, 2.7 to 3.5 wt. % La; 0.1 to 1.6 wt. % Ce; 0.14 to 0.50 wt. % Mn; 0.0003 to 0.0020 wt. % Be, and optionally 0.00 to 0.35 wt. % Zn, 0.00 to 0.40 wt. % Sn, 0.00 to 0.20 wt. % Nd, 0.00 to wt. 0.10 wt. % Pr, the balance being magnesium and unavoidable impurities, wherein the alloying stage starts from charging into alloying furnace pure Mg (at least 99% Mg) and/or primary or secondary Mg—Al master alloys that contain less than 99 wt. % Mg, up to 10.5 wt. % Al, up to 0.9 wt. % Zn and up to 1.5 wt. % Mn, wherein total mass of the above components accounts for up to 105 wt. % of the final melt mass. In the process according to the invention, pure Mg and/or Mg—Al alloys can be charged into the alloying furnace in the solid state or fed in the molten state from another melting apparatus. Solid Mg—Al alloys may be charged into the alloying furnace in ingot form or as a clean die-casting scrap, in the process of the invention. La and Ce may be charged into the alloying furnace as pure metals and/or as a La-based mischmetal and/or Ce-based mischmetal, in the process of the invention. In said process according to the invention, the magnesium alloy preferably comprises 2.6 to 3.7 wt. % Al, 2.8 to 3.3 wt. % La, 0.8 to 1.6 wt. % Ce, 0.15 to 0.40 wt. % Mn, and 0.0006 to 0.0012 wt. % Be. The magnesium alloy may comprise 3.0 to 4.5 wt. % Al, 2.7 to 3.2 wt. % La, 0.8 to 1.6 wt. % Ce, 0.05 to 0.25 wt. % Sn, 0.15 to 0.40 wt. % Mn, and 0.0004 to 0.0012 wt. % Be. In other embodiment, the magnesium alloy comprises 2.9 to 4.3 wt. % Al, 2.7 to 3.4 wt. % La, 0.4 to 1.6 wt. % Ce, 0.05 to 0.15 wt. % Nd, 0.01 to 0.08 wt. % Pr, 0.15 to 0.35 wt. % Mn, 0.03 to 0.09 wt. % Zn, 0.03 to 0.15 wt. % Sn, and 0.0006 to 0.0010 wt. % Be, in the process according to the invention. The alloying procedure is preferably carried out in the temperature range of 670-730° C. in the process of the invention. The settling temperature is preferably 650-690° C. in the process of the invention. In a preferred embodiment of the process according to the invention, the alloy is cast into ingots with the weights of about 6 kg to about 23 kg.

The invention provides a die casting process of a magnesium alloy comprising 2.6 to 5.5 wt. % Al, 2.7 to 3.5 wt. % La, 0.1 to 1.6 wt. % Ce, 0.14 to 0.5 wt. % Mn, 0.0003 to 0.0020 wt. % Be, and optionally 0.00 to 0.35% Zn, 0.00 to 0.40 wt. % Sn, 0.00 to 0.20 wt. % Nd, 0.00 to 0.10 wt. % Pr, and the balance being magnesium and unavoidable impurities, wherein (i) the alloy is cast with the shot sleeve filling ratio of 15-65% in a die having a temperature in the range of 100-340°; (ii) the die is filled in a time between 5 and 250 milliseconds, while the static metal pressures is maintained over casting between 15 and 120 MPa, (iii) the dwell time of the molten metal in the die varies between 3 and 15 seconds. The casting temperature is preferably 660-730° C. in said process, for example 670-710° C. In a preferred embodiment of said process, the magnesium alloy comprises 2.6 to 3.7 wt. % Al, 2.8 to 3.3 wt. % La, 0.8 to 1.6 wt. % Ce, 0.15 to 0.40 wt. % Mn, and 0.0006 to 0.0012 wt. % Be. In other preferred embodiment of said process, the magnesium alloy comprises 3.0 to 4.5 wt. % Al, 2.7 to 3.2 wt. % La, 0.8 to 1.6 wt. % Ce, 0.03 to 0.08 wt. % Zn, 0.15 to 0.40 wt. % Mn, and 0.0004 to 0.0012 wt. % Be. In still another preferred embodiment of said process, the magnesium alloy comprises 2.9 to 4.3 wt. % Al, 2.7 to 3.4 wt. % La, 0.4 to 1.6 wt. % Ce, 0.05 to 0.15 wt. % Nd, 0.01 to 0.05 wt. % Pr, 0.15 to 0.35 wt. % Mn, 0.03 to 0.09 wt. % Zn, 0.03 to 0.15 wt. % Sn, and 0.0006 to 0.0010 wt. % Be. The die casting process of the invention usually results in the TYS values of the alloy at ambient temperature and at 150° C. of at least 144 MPa and 118 MPa, respectively. The die casting process according to the invention usually results in the elongation and impact strength values of the alloy of at least 12% and at least 19 J, respectively.

The invention is directed to articles produced by casting magnesium alloys comprising 2.6 to 5.5 wt. % Aluminum (Al), 2.7 to 3.5 wt. % Lanthanum (La); 0.1 to 1.6 wt. % Cerium (Ce); 0.14 to 0.50 wt. % Manganese (Mn); 0.0003 to 0.0020 wt. % Beryllium (Be), and optionally 0.00 to 0.35 wt. % Zinc (Zn), 0.00 to 0.40 wt. % Tin (Sn), 0.00 to 0.20 wt. % Neodymium (Nd), 0.00 to 0.10 wt. % Praseodymium (Pr), and the balance being magnesium and unavoidable impurities. The alloys, from which the superior articles are cast, are characterized by an advantageous combination of good mechanical properties at ambient and increased temperatures, thermal conductivity, corrosion properties, creep behavior, and casting behavior. Bearing Yield Strength (BYS) of the alloys according to the invention at 20° C. and 150° C. is usually at least 310 and at least 250 MPa, respectively, for example at least 320 and at least 264 MPa, respectively. Shear Strength of the alloys according to the invention at 20° C. and 150° C. is usually at least 160 and at least 130 MPa, respectively. Tensile Yield Strength (TYS) of the alloys according to the invention at 20° C., 150° C., and 175° C. is usually at least 144, at least 118, and at least 107 MPa, respectively. Ultimate Tensile Strength of the alloys according to the invention at 20, 150, and 175° C. is usually at least 250, at least 165, and at least 135 MPa, respectively, for example at least 252, at least 174, and at least 140, respectively. Elongation of the alloys according to the invention at 20° C. is usually at least 12%, and Impact Strength at 20° C. is at least 19 J.

Creep strength of the alloys according to the invention at 150° C. and 175° C., to produce 0.2% strain for 200 h, is usually at least 95 and 80 MPa, respectively, for example at least 97 and 82 MPa, respectively. Bolt Load Retention at initial stress of 80 MPa at 150° C. and 175° C. is usually at least 69 and 51%, respectively.

Thermal conductivity of the alloys according to the invention at 20° C. is at least 85 W/K·m, for example at least 86 W/K·m.

Corrosion Rate of the alloys according to the invention under SAE J2334 cyclic corrosion test is at most 1.00 mpy, preferably at most 0.79 mpy.

The embrittlement effect of aging at 150° C. on the ductility of the alloys according to the invention, when measured as relative reduction in elongation, is at most 20%, for example at most 15%.

BRIEF DESCRIPTION OF THE DRAWINGS

The above and other characteristics and advantages of the invention will be more readily apparent through the following examples, and with reference to the appended tables, wherein:

FIG. 1. is Table 1, showing chemical compositions of alloys according to the invention and of comparative alloys;

FIG. 3. is Table 2 showing die casting parameters used at evaluation of susceptibility to hot cracking;

FIG. 4. is table 3 showing percentage of crack free junctions for different alloys and die casting parameters;

FIG. 5. is Table 4, showing bearing, shear, tensile and impact strength properties of the alloys;

FIG. 6. is Table 5, showing the creep behavior, bolt load retention properties, corrosion resistance, and thermal conductivity of the alloys; and FIG. 7. is Table 6, showing variation of tensile properties depending on aging conditions.

DETAILED DESCRIPTION OF THE PREFERRED EMBODIMENTS

Figure 2:
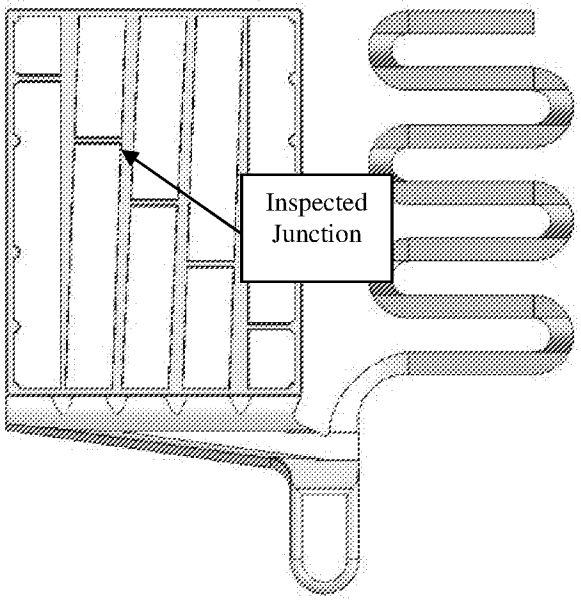
FIG. 2. shows the casting shot used for evaluation of susceptibility to hot cracking.

It has been found that magnesium alloys exhibiting a superior combination of castability, mechanical and corrosion properties as well as thermal conductivity are obtained at affordable cost, when comprising certain elements as explained below. The present invention provides a family of magnesium based alloys comprising from 2.6 to 5.5 wt. % aluminum (Al), from 2.7 to 3.5 wt. % Lanthanum (La), from 0.1 to 1.6 wt. % Cerium (Ce); from 0.14 to 0.50% Manganese (Mn), from 0.0003 to 0.0020 wt. % Beryllium (Be), and optionally up to 0.35 wt. % Zinc (Zn); up to 0.40 wt. % Tin (Sn), up to 0.20 wt. % Neodymium (Nd), and up to 0.10 wt. % Praseodymium (Pr). The alloys of the invention may comprise incidental impurities that are normally present in magnesium alloys. Said alloys may comprise up to 0.004 wt. % Fe, up to 0.002 wt. % Ni, up to 0.08% Si and up to 0.01 Wt. % Cu.

The invention is directed to an article produced by casting a magnesium alloy comprising from 2.6 to 5.5 wt. % Al, from 2.7 to 3.5 wt. % La, 0.1 to 1.6 wt. % Ce, from 0.14 to 0.50% Mn, from 0.0003 to 0.0020 wt. % Be; and optionally up to 0.35 wt. % Zn, up to 0.40 wt. % Sn, up to 0.20 wt. % Nd and up to 0.10% Pr. Said casting is preferably high-pressure die casting, however it may be also thixomolding, semisolid casting, squeeze casting, and gravity casting as well as low-pressure casting.

The alloy of the invention exhibits superior bearing and shear properties both at room and elevated temperatures. The alloy also has excellent castability combined with superior corrosion resistance and impact strength properties, excellent creep performance and bolt load retention properties as well as exceptionally good ductility, impact strength properties and thermal conductivity. Alloying with Lanthanum and Cerium leads to the formation of stable intermetallics at grain boundaries of Mg—Al solid solution. Enhanced stability of these intermetallics at elevated temperatures results in superior alloy performance at service temperatures of up to at least 175° C. The alloys of the present invention further display low susceptibility to hot tearing and are not prone to die sticking and soldering over high-pressure die casting process, thixomolding and other casting processes. They also have excellent fluidity and are not prone to oxidation and burning.

An alloy of the present invention exhibits exceptionally good impact strength, bearing strength and shear strength in combination with excellent creep and bolt load retention properties at temperatures up to 200° C. For the new alloys, the creep strength to produce 0.2% strain for 200 h is varied between 97 MPa to 108 MPa at testing temperature of 150° C., and between 80 MPa to 88 MPa at testing temperature of 175° C. An alloy according to the invention exhibits excellent Bearing Yield Strength (BYS) that is typically 320 MPa or more, said BYS values being preferably 330 MPa or more at room temperature. At 150° C., BYS values are typically more than 264 MPa, such as 270 MPa or more. An alloy according to the invention shows exceptionally good combination of tensile yield strength, ultimate tensile strength, elongation and impact strength properties. These alloys are not prone to embrittlement over long-term aging at 150° C. that simulates to a large extent the service conditions. Impact strength of the alloys is typically about 20 J while elongation is typically about 15%. Shear strength of the alloys is typically about 160 MPa or more at ambient temperature, and typically about 130 MPa or more at 150° C.; said shear strength values being in some embodiments 165 MPa or more at ambient temperature and 135 MPa or more at 150° C. Thermal conductivity of the alloys is typically about 85 W/K·m or more. The alloys according to the invention combine excellent bearing and shear properties with exceptionally good ductility, creep behavior and bold load retention properties. These alloys also have better corrosion resistance than comparative alloys.

Magnesium-based casting alloys, which have chemical compositions according to the present invention, as noted hereinbefore outperform the prior art alloys in mechanical, technological, and corrosion properties. These properties include excellent molten metal behavior and castability combined with improved bearing, shear, tensile and impact strength properties, and as well as excellent corrosion and creep resistance, ductility, and bolt load retention properties. The alloys of the present invention contain aluminum, lanthanum, cerium, manganese, and beryllium. As discussed below they may also contain other elements as additional ingredients, or incidental impurities.

The magnesium-based alloy of the present invention comprises 2.6 to 5.5 wt. % aluminum. If the aluminum concentration is less than 2.6 wt. %, the alloy will exhibit poor castability properties, particularly low fluidity, insufficient strength properties, and remarkable tendency to shrinkage formation on top surface of ingots that in some cases may lead even to cracks formation. On the other hand, aluminum concentration higher than 5.5 wt. % leads to significantly lower susceptibility to hot cracking, deterioration of ductility, impact strength properties, bearing strength, creep resistance, bolt load retention properties and thermal conductivity.

The preferred ranges for Lanthanum and Cerium are 2.7 to 3.5 wt. %, and 0.1 to 1.6 wt. %, respectively. The above two elements form with aluminum stable eutectic intermetallic compounds that impede grain sliding. In addition, alloying with La and Ce leads to prevention of formation of brittle $Mg_{17}Al_{12}$, intermetallic compounds. Both these factors improve creep resistance. Furthermore, it was unexpectedly found that when La is dominating alloying element, the main intermetallic compound is $Al_{11}(La,Ce)_3$. This phase is much preferable than $Al_2(Ce, La)$ intermetallic phase which is mainly formed in alloys enriched in Ce. This is related to the fact that in the $Al_{11}(La,Ce)_3$ intermetallic phase more than 3.5 aluminum atoms are bound to one RE elements atom, while in the $Al_2(Ce, La)$ intermetallic phase just two Al atoms are bound to one RE elements atom. Thus, once the $Al_{11}(La,Ce)_3$ eutectic intermetallic compound is formed, lower concentration of RE elements is required to suppress the formation of $Mg_{17}Al_{12}$ intermetallics, harmful for creep resistance. On the other hand, at the same concentrations of La and Ce, more eutectic phase is formed in the case of $Al_{11}(La,Ce)_3$ intermetallics than in the case of $Al_2(Ce, La)$ intermetallics. This in turn leads to shortening the freezing range and lower susceptibility to hot cracking.

If the Lanthanum content is less than 2.7 wt. %, it does not gives rise to the formation of sufficient amount of $Al_{11}(La,Ce)_3$ intermetallics, thereby leading to the deterioration of creep resistance and to increased tendency to hot cracking. It should be noted that the $Al_{11}(La,Ce)_3$ intermetallic compound, which is enriched in La is more stable than that one enriched in Ce. On the other hand, the La content higher than 3.5% results in reduced fluidity, excessive oxidation and melt loss, necessity of additional stirring at the die casting furnace and unnecessarily further increase of the alloy cost because La is more expensive than Mg. The effect of La is more remarkable in combination with Ce. The Ce content less than 0.1% insignificantly affects the formation of $Al_{11}(La,Ce)_3$ intermetallics. The Ce concentration higher than 1.6% results in intensive formation of less desirable $AL_2(La,Ce)$ intermetallic phase at the expense of $Al_{11}(La,Ce)_3$ intermetallics. In addition, it also leads to decreasing the alloy fluidity, increasing the melt loss without stirring at the die casting shop and unnecessarily further increase of the alloy cost. Beryllium is added into alloys of this invention in the amount of 0.0003 to 0.0020 wt. % in order to prevent burning, and to reduce dross and sludge formation. The Be content less than 0.0003% does not provide effective protection against oxidation. The Be content higher than 0.0020 leads to contamination by non-metallic inclusions and unreasonable increase of an alloy cost.

It was also unexpectedly found that small additions of Zn in the range of up to 0.35 wt. %, such as between 0.05 and 0.25 wt %, may improve castability and creep resistance. On the other hand, the Zn content higher than 0.35% results in increased tendency to die sticking and deterioration of creep resistance. This positive effect of Zn is more remarkable in the presence of Sn in the range of up to 0.40 wt. %. The Sn content higher than 0.40 wt. % may result in the deterioration of creep resistance and in unjustified increase of the alloy cost. The alloys of the present invention contain minimal amounts of iron, copper and nickel, to maintain a low corrosion rate. There is preferably less than 0.004 wt. % iron, and more preferably less than 0.003 wt. % iron. A low iron content can be obtained by adding manganese. The iron content of less than 0.003 wt. % can be achieved at minimal residual manganese content 0.14 wt. % in the alloy. Adding Mn in amounts higher than 0.50 wt. % leads to reduction of ductility and impact strength, unjustified increase of the alloy cost and to excessive sludge formation over ingots remelting and melt holding prior to the high-pressure die casting process. Optionally, the alloys of the present invention may also contain up to 0.20 wt % Nd, and up to 0.10% Pr.

The magnesium alloys of the instant invention exhibit high impact strength, bearing strength and shear strength, as well as enhanced ductility combined with excellent creep resistance and bolt load retention properties. They also have excellent castability and corrosion resistance.

The invention will be further described and illustrated in the following examples.

EXAMPLES

General Procedures

Series of experiments were contacted using the electric resistant furnace with 120 liter crucibles made of low carbon steel. During melting and holding, the melt was protected under a gas mixture of $CO_2$+0.5% HFC134a The experimental alloys were prepared using different starting materials: pure Mg of grade 9980A as well as Magnesium alloys of AM and AZ alloying systems comprising 0.001-10.5 wt. % of Aluminum, 0.05-2.5 wt. % of Manganese and 0.001-1.5% Zn (for example, M2, AM20, AM50 AM60, AM100, AZ91D). The above alloys were used in the form of ingots or as a clean die casting scrap. The alloying procedure was performed in the temperature range of 670-730° C.

Manganese—an Al—Mn master alloy containing 60-90% Mn, compacted Mn powder and M2 magnesium alloy containing about 2% Mn were used for alloying with Mn. The above materials were added to molten metal at a melt temperatures from 700° C. to 740° C., depending on the manganese concentration in the master alloy.

Aluminum—commercially pure Al containing less than 0.2% impurities was used in some cases for the chemical composition correction.

Rare earth elements—a lanthanum based mischmetal comprising 70-80% La+20-30% Ce and a cerium based mischmetal comprising 65% Ce+35% La were mainly used. In addition, pure La, pure Nd and pure Pr were partially used along with a cerium based mischmetal comprising 50% Ce+25% La+20% Nd+5% Pr.

Tin—pure tin containing less than 0.5% impurities was used.

Zinc—pure zinc containing less than 0.3% impurities was used.

Beryllium—up to 20 ppm of beryllium were added to the new alloys in the form of a master alloy Al-1% Be, following settling the melt at temperatures of 650-690° C. prior to casting.

After obtaining the required compositions, the alloys were cast into the 12 kg ingots. Neither burning nor oxidation was observed on the surface of all the experimental ingots.

On the second stage, the above experiments were carried out in the industrial conditions using alloying furnace with the capacity of 2 tons. In the above experiments pure Mg or Mg alloys were transferred to the alloying furnace in the molten state from the continues refining furnace with the capacity of 20 tons. After alloys preparation and settling, the molten metal was cast into ingots with weights varied between 6 to 23 kg in different experiments.

Chemical analyses were conducted using spark emission spectrometer.

The die casting trials were carried out using an IDRA OL-320 cold chamber die casting machine with a 345 ton locking force.

Die lubrication (Acheson cp-593 lubricant) and metal ladling were performed manually. The mixture of $CO_2$+0.5% HFC134a with flow rate of 20 l/min was used as a protective gas.

The casting temperature was varied in the range of 660-720° C. while the die temperature was varied between 100 and 340° C. for different compositions and experiments. The die was filled in a time between 5 and 250 milliseconds. The shot sleeve filling ratio was varied in the range of 15-65%. The static metal pressures that was maintained during casting varied between 15 and 120 MPa. The dwell time of the molten metal in the die was varied between 3 and 15 seconds.

Experiments for evaluation of alloy susceptibility to hot cracking were performed using a specially designed test-part schematically shown in FIG. 2.

Prior to experimental casting, the main HPDC process parameters, such as injection profile, melt temperature and die temperature, were optimized for the test-part shown in FIG. 2 according to the physical properties of each alloy. The part is divided into several sections. Each section contains a junction between different wall thicknesses. The impact strength specimens are designated for evaluation of properties homogeneity throughout the test-part and were not addressed in the present invention.

All HPDC samples were X-rayed using SIEFERT ERSCO 200 MF constant potential X-ray tube. Table 1 presents the process parameters that were examined. The second phase velocity, different intensification pressure and molten metal temperature were used as variable parameters for each alloy tested. These parameters were selected in order to generate solidification shrinkage which in turn causes hot cracking during solidification of the casting. For each of the 24 variants listed in Table 2, ten components were die cast in order to obtain representative results.

As can be seen in FIG. 2, the hot cracking evaluation part was designed with different thicknesses in order to provide different solidification time. Each wall section has different thickness and therefore it solidifies differently. The shrinkage between the wall sections causes hot cracking formation. The parts were inspected in terms of hot cracking appearance, and then the results obtained at different junctions were averaged. This procedure was performed for ten parts that were cast at the same casting conditions (temperature, pressure, plunger velocity) with subsequent averaging of results obtained on all parts.

Corrosion performance was evaluated by SAE J2334 cyclic corrosion test, which is considered as showing the best correlation with car exploitation conditions. According to the above standard, each cycle required a 6 hours dwell in 100% RH atmosphere at 50° C., a 17.4 hours dry stage in 50% RH atmosphere at 60° C. Between the main stages a 15 minutes dip in an aqueous solution (0.5% NaCl, 0.1% $CaCl_2$, 0.07% $NaHCO_3$) was performed. At weekends and holidays the test was ran on the dry mode. The test duration was 80 cycles that corresponds to 5 years of car exploitation. The tests were performed on plates with dimensions of 140+100+3 mm. The plates were degreased in acetone and weighed prior to the immersion in the test solution. Five replicates of each alloy were tested. At the end of the test, the corrosion products were stripped in a chromic acid solution (180 g $CrO_3$ per liter solution) at 80° C. about three minutes and the weight loss was determined. Then the weight loss was used to calculate the average corrosion rate in mils per year (MPY) over the 80 days period.

Tensile testing at ambient and elevated temperatures was performed using an Instron 4483 machine equipped with an elevated temperature cabinet as per ASTM standards B557M. Tensile yield strength (TYS), Ultimate Tensile Strength (UTS) and percent elongation (% E) were measured. The Shear Strength was measured as per ASTM B565 standard using cylindrical samples with a 6 mm diameter excised from the gage area of tensile samples. The Bearing yield strength was measured as per ASTM E 238-84(08) standard using the corrosion plates with dimensions of 100×140×3 mm having a hole for pin with 8 mm diameter. Edge distance of 2 mm was used. Bearing Yield Strength was calculated as offset equal to 2% of the pin diameter. The impact strength properties were tested on Charpy hammer. Un-notched specimens with dimensions of 10 mm×10 mm×55 mm were used.

The SATEC Model M-3 machine was used for creep testing. Creep tests were performed at 150° C. and 175° C. for 200 hrs under a stresses in the range of 40 to 110 MPa in order to determine the creep strengths at the above temperatures. Furthermore, bolt load retention was measured. This parameter is used to simulate the relaxation that may occur in service conditions under a compressive loading. The cylindrical samples with outside diameter of 17 mm containing whole with a 10 mm diameter and having height of 18 mm were used. These specimens were loaded to certain stress using hardened 440C stainless still washers and a high strength M8 bolt instrumented with strain gages. The change in load over 200 h at 150° C. and 175° C. was measured continuously. The ratio of two loads, namely the load at the completion of the test after returning at ambient condition to the initial load at room temperature is a measure of the bolt load retention behavior of an alloy.

Examples of Alloys

Tables 1 to 6 present chemical compositions and properties of alloys according to the invention and alloys of comparative examples. The chemical compositions of 12 novel alloys along with 8 comparative examples are listed in table 1.

Table 3 demonstrates that new alloys exhibit lower susceptibility to hot cracking than comparative alloys at all second phase piston velocities and intensification pressures estimated by percentage of crack free junctions as it is shown in FIG. 2.

Table 4 shows the bearing, shear, impact strength and tensile properties of new alloys along with those of the comparative alloys. The alloys of the present invention exhibit significantly higher Bearing Yield Strength (BYS) and Impact Strength than those of comparative alloys. Furthermore, Shear Strength, Tensile Yield Strength (TYS) and Ultimate Tensile Strength (UTS) of new alloys also surpass those properties of comparative alloys both at ambient temperature and at 150° C. The main difference is also seen in elongation values of new alloys of present invention and comparative alloys.

Table 5 demonstrates creep behavior, bolt load retention properties and corrosion resistance of new alloys along with those properties of comparative alloys. Corrosion resistance of new alloys evaluated under SAE J2334 cycling outperforms that of the alloys of Comparative Examples. As can be seen from Table 5, the alloys of the present invention are superior to the comparative alloys in creep resistance and bolt load retention properties. One of important requirements to creep-resistant alloys is their ability to maintain mechanical properties over exploitation period. Since creep resistant magnesium alloys should serve in the temperature range of 120-170° C. the ability of the alloys to maintain their properties can be evaluated by comparison the properties of as cast material and after long-term aging for 2000 h at the temperature of 150° C. (Table 6). This table clearly demonstrates that the alloys of present invention have much more stable properties than comparative alloys. This is most remarkable for elongation. This property after aging at 150° C. for 2000 h experiences reduction of 7-15% for the alloys of instant invention while the elongation of comparative alloys undergoes the reduction in the range of 25-44% under the same test.

While this invention has been described in terms of some specific embodiments, it will be appreciated that other forms can readily be adapted by one skilled in the art. It is therefore understood that within the scope of the appended claims, the invention may be realized otherwise than as specifically described.

The invention claimed is:

1. A creep resistant ductile magnesium alloy maintaining mechanical properties at high working temperatures, said mechanical properties including tensile yield strength and ultimate yield strength at 150° c. of at least 118 and 165 mpa, respectively, said alloy consisting of 2.7 to 3.5 wt. % lanthanum (la), 2.6 to 5.5 wt. % aluminum (al), 0.1 to 1.6 wt. % cerium (ce), 0.14 to 0.50 wt. % manganese (mn), 0.0003 to 0.0020 wt. % beryllium (be), 0.05 to 0.25 wt. % zinc (zn), 0.02 to 0.38 wt. % tin (sn), 0.00 to 0.20 wt. % neodymium (nd), and 0.00 to 0.10 wt. % praseodymium (pr), and the balance being magnesium and unavoidable impurities, wherein said alloy is suitable for die casting and maintains elongation of more than 10% even after aging at a temperature of 150° c. for 2000 hours.

2. An article produced by casting a magnesium alloy of claim 1.

* * * * *